United States Patent [19]

Nishikawa et al.

[11] Patent Number: 4,611,733

[45] Date of Patent: Sep. 16, 1986

[54] APPARATUS FOR AUTOMATICALLY RELOCATING THE STOCKING TOE PART CORRECTLY ON THE SETTING FRAME

[75] Inventors: Masao Nishikawa, Nara; Michikazu Naohara, Yamatotakada, both of Japan

[73] Assignee: Takatori Machinery Mfg. Co., Ltd., Nara, Japan

[21] Appl. No.: 744,688

[22] Filed: Jun. 14, 1985

[30] Foreign Application Priority Data

Jun. 22, 1984 [JP] Japan ..... 59-129871

[51] Int. Cl.[4] ..... D06C 5/00; A47G 25/80

[52] U.S. Cl. ..... 223/75; 223/111

[58] Field of Search ..... 223/75, 76, 77, 111

[56] References Cited

U.S. PATENT DOCUMENTS

| | | | |
|---|---|---|---|
| 3,121,520 | 2/1964 | Gann | 223/76 |
| 3,481,516 | 12/1969 | Horberg | 223/76 |
| 3,520,262 | 7/1970 | Bolles et al. | 223/76 X |
| 4,515,299 | 5/1985 | Sewell | 223/76 |

FOREIGN PATENT DOCUMENTS

| | | | |
|---|---|---|---|
| 2088425 | 6/1982 | United Kingdom | 223/75 |

*Primary Examiner*—Louis K. Rimrodt

*Attorney, Agent, or Firm*—Wenderoth, Lind & Ponack

[57] ABSTRACT

This apparatus automatically relocates the stocking toe part correctly on a setting frame prior to steam setting when the toe part is misplaced. The apparatus essentially comprises a pair of relocating members and a seam locator: the relocating members hold the stocking toe part together with a setting frame from both sides; the seam locator, essentially composed of a number of electrodes and a sheet of piezoelectric conductive rubber, locates a misplaced seam line by its protrusion on the setting frame and causes the relocating members to slip the seam line transversally to a certain extent on the setting frame so as to correct its position. Thus the magnitude of slip is determined by the relative position of the seam line and by one of the electrodes which has sensed the protrusion of the seam line so that the apparatus may automatically relocate the stocking toe part correctly on the setting frame.

6 Claims, 10 Drawing Figures

APPARATUS FOR AUTOMATICALLY RELOCATING THE STOCKING TOE PART CORRECTLY ON THE SETTING FRAME

BACKGROUND OF THE INVENTION

1. Field of the Invention

This invention concerns an apparatus for relocating the stocking toe part in the right position when it is put incorrectly on a setting frame of a finishing machine. More particularly, this invention concerns an apparatus for automatically relocating the stocking toe part in the right position when it is mis-placed on a setting frame of a finishing machine by causing a seam locator to find a seam on the stocking toe part and then causing a relocating means to bring the stocking toe part to the given right position.

2. Description of the Prior Art

In conventional automatic stocking-setting apparatuses, a variety of disclosures have already been published and some of them have actually been put into practice. Among them, there are an apparatus that enables workers to mount a number of stockings on a setting frame at one time and an apparatus that can automatically mount many pairs of stockings on a setting frame one after another.

Commonly those apparatuses have a holder to inflate stockings from the inside. Besides, they are designed in such a way that stockings can completely fit on a setting frame while the holder is being lowered from the top to the bottom of the setting frame. Nevertheless, because stockings do not fit on a setting frame very well, a device for pushing them down on the setting frame has also been developed.

Such being the case, according to those recent automatic stocking mounting apparatuses, workers only have to do is bring stockings to a holder with their opening widened; then, the rest of the work is all finished in an automatic manner. Thus, the working efficiency is improved very much with the result that the exhaustion of workers is considerably reduced, and this results in increasing the productivity of a finishing machine.

For all that such a series of automated processes have accomplished, the stocking toe part is not always fixed to a given part of a setting frame; on the contrary, it is much more frequently misplaced than placed in the right position.

As FIG. 5 shows, stockings H (especially, hosiery such as women's seamless stockings and pantyhose) already have a circular seam S at the toe part before undergoing steam-setting in a finishing machine; hence, the top of a setting frame F is shaped so as to fit to the circular seams. Therefore, when stockings H are put on the setting frame F, the circular seam S has to be put on its top T correctly. If the circular seam S is not on its top T in the right position as seen in FIGS. 6 and 7, the stocking toe part will be set in a twisted position in relation to its leg part L. Consequently, the merchandise value of those stockings H is greatly reduced; in addition, those who wear them may feel uneasy. From these points of view, such stockings H need re-setting. However resetting requires careful handwork. Thus, in conventional hosiery workshops, many workers entirely engaged in resetting are required. Accordingly, even if an automatic stocking mounting apparatus is introduced, the merit resulting therefrom is decreased by half, so that improvement in such labor-intensive work has long been awaited.

SUMMARY OF THE INVENTION

It is an object of this invention to provide an apparatus for automatically relocating the stocking toe part correctly on a setting frame. It is another object of this invention to provide an apparatus for automatically relocating the stocking toe part correctly on a setting frame with which full automation of the stocking finishing process is realized. It is still another object of this invention to provide an apparatus for automatically relocating the stocking toe part correctly on a setting frame (hereinafter referred to as an automatic stocking relocating apparatus) by which a hosiery of high merchandise value can be produced. The above and other objects and features of this invention will appear more fully hereinafter from a consideration taken in connection with the accompanying drawing wherein one example is illustrated.

BRIEF DESCRIPTION OF THE DRAWINGS

FIG. 5 shows a condition that a stocking is put on a setting frame correctly; FIGS. 6 and 7 show a condition that stockings are put on a setting frame incorrectly, with the result that their seam gets out of the circular top of the setting frame.

DETAILED DESCRIPTION OF THE PREFERRED EMBODIMENTS

In order to help the understanding of this invention, first of all the outline of a commonly used stocking finishing machine will be described and then the disposition of the automatic stocking relocating apparatus will be related in regard to the finishing machine.

Figure 8:
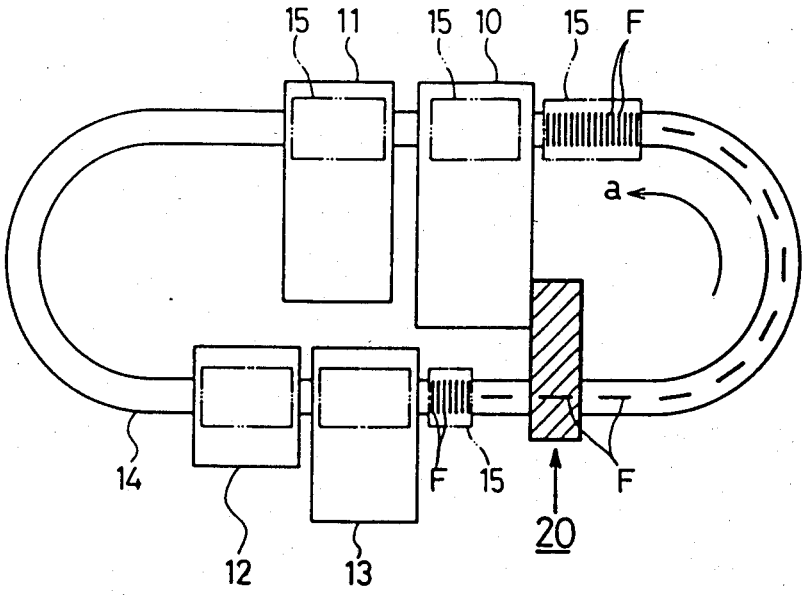
FIG. 8 is a plan view showing the arrangement of the automatic stocking relocating apparatus of this invention in relation to a finishing machine.

In FIG. 8, the numeral 10 designates a steam setter; the numeral 11 designates a dryer; the numeral 12 designates a device for taking out stockings; and the numeral 13 designates a device for mounting stockings on setting frames; all of which are disposed on an endless conveyor 14. The automatic stocking relocating apparatus 20 of this invention is installed after the mounting device 13 in terms of the circulating direction of the conveyor 14. A plurality of carriages 15 constructed of a pantographic framework that holds a plurality of stocking-setting frames F in the upright position are fixed on the endless conveyor 14 and they are moved in the arrow-headed direction a by means of an appropriate driving apparatus (not shown here). Hence, stockings held in the carriages 15 are subjected to steam-set at the steam-setter 10, dried at the dryer 11 and then taken out at the taking-out device 12. After stockings have been taken out, the carriages 15 are transferred to the mounting device 13 where yet steam-untreated stockings are mounted on the setting frames F of the carriages 15. After each of the stockings is mounted on each setting frame F, the carriages 15 leave the mounting device 13 and the setting frames F advance on the conveyor 14, increasing their mutual distance by the deployment action of the carriage 15 and making a stop intermittently. At this moment, the automatic stocking relocation apparatus 20 of this invention is used to replace a stocking toe part correctly on the setting frame F at the time the carriage 15 is making a stop for a while.

The construction of the automatic stocking relocating apparatus will be described in detail with reference to the accompanying drawings.

Figure 1:
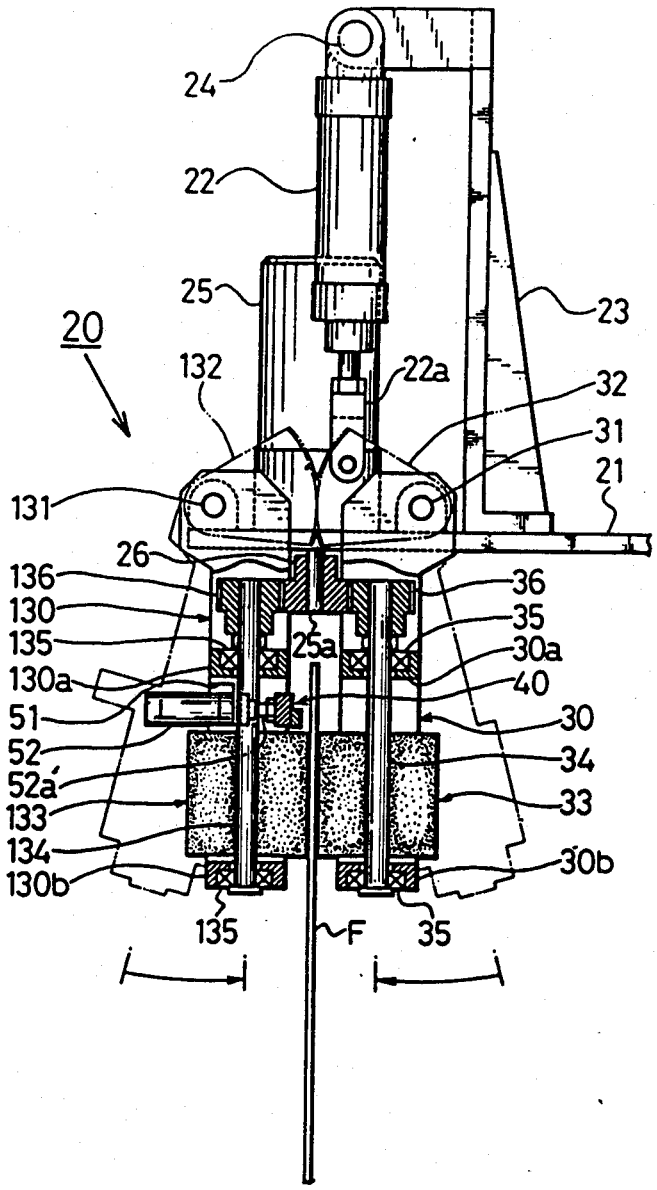
FIG. 1 is a partially cutaway side view of an automatic stocking relocating apparatus of this invention.
Figure 2:
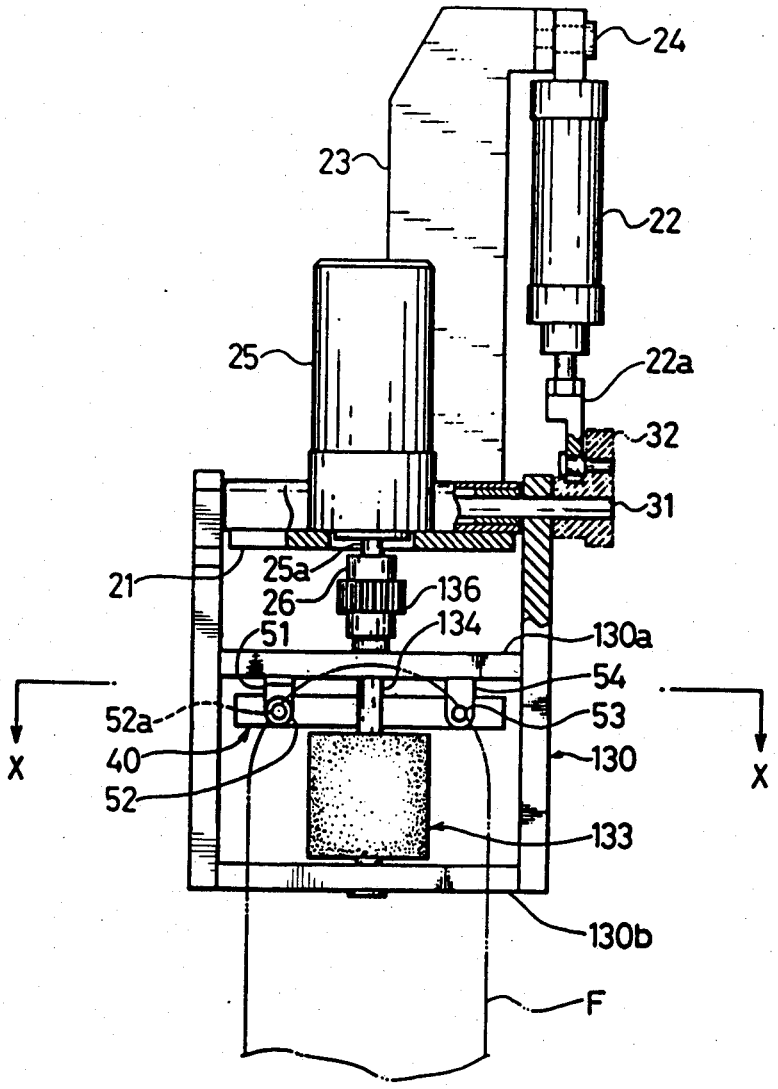
FIG. 2 is a front view of the same apparatus of this invention.
Figure 3:
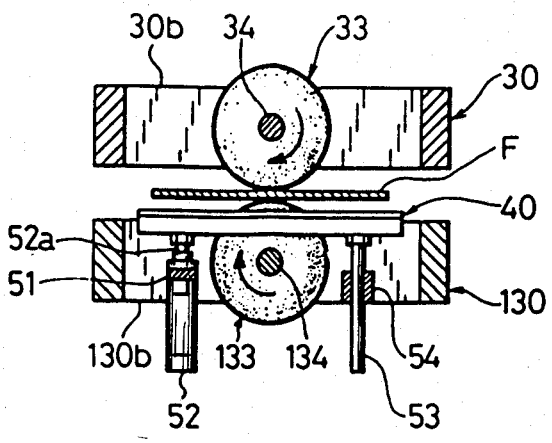
FIG. 3 is a transversally cutaway view of the same apparatus taken along the line X—X in FIG. 2.

As stated above, the automatic stocking relocating apparatus 20 of this invention is disposed after the mounting device 13 in terms of the turning direction of the conveyor 14 in such a way that the setting frames F can pass through thereunder increasing the distance from the one going ahead and making intermittent stops. In FIGS. 1, 2 and 3, just above the setting frames F traveling on the conveyor 14, a base plate 21 is supported horizontally by stays (not shown here). A couple of swingable members 30, 130 having a framework as shown in FIG. 2 dangle from the shafts 31, 131 in such a way that they can hold a setting frome F from both sides. Fastened to the same end of the shafts 31, 131 are fan-shaped gears 32, 132 meshing with each other, and a piston 22*a* of an air cylinder 22 is joined to one gear 32 of the gears. The upper part of the pneumatic cylinder 22 is pivotally attached to an arm of a bracket 23 with a pin 24. Thus, as the piston 22*a* moves ups and downs by means of the pneumatic cylinder 22, the shafts 31, 131 rotate by way of the fan-shaped gears 32, 132 and a pair of swingable members 30, 130 make a swinging movement between the position in operation (shown by a solid line in FIG. 1) and the position out of operation (shown by a chain line in FIG. 1). The swingable members 30, 130 are usually kept on standby in the position out of operation.

A pair of relocating means 33, 133 used to correct the position of the stocking toe part T on a setting frame F is attached to the swingable members 30, 130. As shown in FIG. 1, a pair of vertical, parallel shafts 34, 134 are fixed between horizontal frames 30*a*, 30*b* and between horizontal frames 130*a*, 130*b* so as to be rotatable with the aid of bearings 35, 135. A pair of relocating means 33, 133 in the form of a roller, the surface of which is covered with a wear-resistant, frictional synthetic rubber, for example, as shown in FIG. 3 is fitted on the vertical, parallel shafts 34, 134. Moreover, a pair of gears 36, 136 is fastened to the upper ends of the shafts 34, 134 which project upward out of the horizontal frames 30*a*, 130*a*. A motor 25 is installed on the base plate 21; an output shaft 25*a* of the motor 25 is made to project downward out of the base plate 21; a gear 26 is fastened to the output shaft 25*a*. The structure being is such that, when the swingable members 30, 130 swing inward to the position in operation, they can hold a setting frame F on both sides and the gears 36, 136 can mesh with the gear 26 fixed to the output shaft 25*a* of the motor 25. Thus, when the motor 25 starts, the relocating members 33, 133 are rotated by way of the gears 36, 136. More particularly, when the motor 25 rotates in the positive direction, the relocating members 33, 133 rotate clockwise as shown by an arrow-headed mark in FIG. 3; when the motor 25 rotates in the negative direction, they rotate counter-clockwise.

In connection with the rotation, the motor 25 may be a pulse motor of conventional type whose drive can be put under control of signals transmitted from a device 40 for locating a seam of the stocking toe part, as described in the following discussion.

As shown in FIGS. 1, 2 and 3, the seam locater 40 is provided on the side of one member 130 of the swingable members 30, 130. Specifically, the seam locator 40 is attached to a piston 52*a* of a small pneumatic cylinder 52 that is supported by a bracket 51 fixed to the under surface of the horizontal frame 130*a* (FIGS. 1 and 2). As apparent in FIG. 1, the seam locator 40 can move forward and backward by the action of the small pneumatic cylinder 52 when the swingable members 30, 130 are in the position in operation. Thus, the seam locator 40 can touch one side (for example, the top side) of the setting frame F and get away from it.

Figure 4:
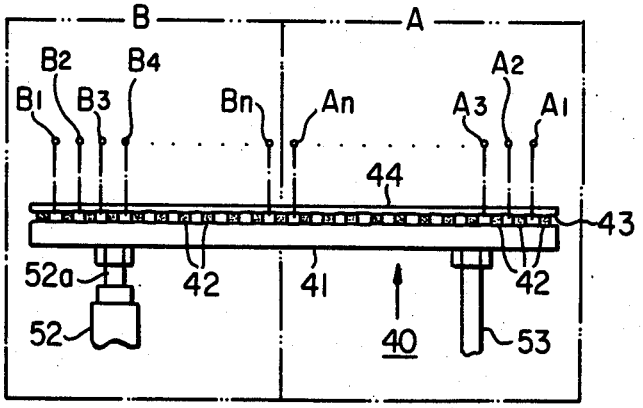
FIG. 4 is an enlarged plan view of a seam locator of the same apparatus.
Figure 5:
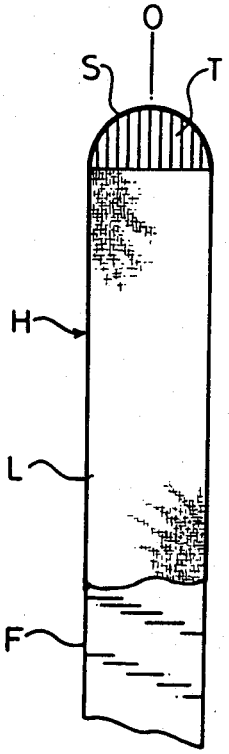
FIGS. 5, 6 and 7 are illustrations showing stockings mounted on a setting frame, where

The numeral 53 in FIGS. 2–4 designates a guide shaft, one end of which is fixed to the seam locator 40, which is fitted into a bracket 54 provided on the under surface of the horizontal frame 130*a* (FIGS. 1 and 2); thus, the shaft 53 serves as a guide for the seam locator 40 which moves back and forth.

The seam locator 40 will be explained in more detail with reference to FIG. 4. Fixed on the bottom of a plate 41 are the piston 52*a* of the small pneumatic cylinder 52 and the guide shaft 53. Provided on the top side of the plate 41 are a good number of electrodes 42 circuited in parallel at a given interval in the longitudinal direction of the plate 41. They are covered with a sheet of piezoelectric conductive rubber 43 (for example, a piezoelectric conductive composite material made up of silicon rubber and a metal powder). A protective sheet 44 like a metal foil is applied on the sheet 43 so as to make up the whole seam locator 40 as a single switch element. The seam locator 40 has such a construction that part of the rubber sheet 43 becomes discontinuous where a pressure of more than a limit is applied on the protective sheet 44, whereas the other part where the pressure is not applied stays insulated. As a result of the occurrence of the partial continuity, a driving pulse generates from an oscillation circuit (not shown here). The driving pulse is then converted into a predetermined frequency by means of a dividing circuit (not shown here) so that it can be accepted by the pulse motor 25. At this moment, the motor 25 is put under control based on the program stored in the electrodes 42.

In relation to the above, in this example a number of the circuited electrodes 42 on the top side of the plate are divided into two blocks: A and B for example. The motor 25 is controlled so as to rotate in the positive direction when the electrodes in the block A get into continuity and rotate in the negative direction when the electrodes 42 in the block B complete a circuit.

Moreover, the number of the electrodes 42 in the block A is identified as $A_1$, $A_2$, . . . $A_n$ and the number of the electrodes 42 in the block B is identified as $B_1$, $B_2$, . . . $B_n$, whereby the motor 25 is caused to rotate in the positive direction for as many rotations as possible for two pulses when one electrode $A_2$ in the block A complete a circuit, for example. Similarly, the motor 25 is caused to rotate in the negative direction for as many rotations as possible for three pulses when one electrode $B_3$ in the block B completes a circuit, for example.

As stated above in regard to FIG. 8, a group of yet steam-untreated stockings H put on the setting frames F start increasing their mutual interval as soon as they get out of the mounting device 13. They move and stop intermittently toward the steam setter 10 on the conveyor 14 and while they are making a stop, the automatic stocking relocating apparatus 20 of this invention conducts the relocation of the stocking toe part. The setting frames F put in the deployment position make an advance and a stop intermittently; they stop for a while at a position and function as shown in FIGS. 1 and 2. Their stop is sensed by an appropriate detector like a limit switch. The pneumatic cylinder 22 of FIG. 1 moves receiving the sense and causes the swingable members 30, 130 to swing from the position out of operation to the position in operation. In association with the movement of the swingable members 30, 130, the gears 36, 136 are engaged with the driving gear 26 and the relocating members 33, 133 are pressed against both sides of a setting frame F at the toe part of a stocking. Subsequently, the seam locator 40 moves forward by the action of the small pneumatic cylinder 52 and presses the piezoelectric conductive rubber sheet 43 of FIG. 4, covered with the protective sheet 44, against one side of the stocking toe part T. A seam makes a line of protrusion on the knit of the stocking; thus, if the seam is put on the verge of the setting frame F correctly, there is no line of protrusion on the side where the piezoelectric conductive rubber sheet 43 is pressed; therefore, the seam locator 40 can find no seam there. Accordingly, the relocating means 33, 133 do not move; the swingable members 30, 130 return to the position out of operation by the reverse action of the pneumatic cylinder 22; thus, the setting frame F is allowed to pass the gate.

Figure 6:
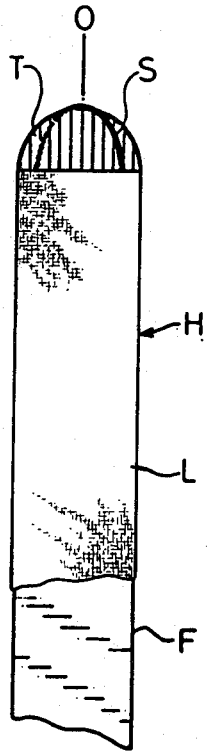

If, however, a seam is mis-placed deviating from the correct position as FIG. 6 shows, in terms of the center line O (in this case, the part of the seam on the other side of the setting frame F lies nearly symmetrical with the part of the seam S on this side), the part of the piezoelectric conductive rubber sheet 43 correspondent to a line of the protruded seam is pressed more strongly than the other part by the same seam. On account of this pressure, those electrodes 42 in line with the pressure complete a circuit so as to allow the apparatus to operate and relocate the seam. At this moment, if the $A_5$ electrode in the A block completes a circuit, the motor 25 rotates for five pulses in the positive direction.

The seam locator 40 moves backward by the reverse action of the small pneumatic cylinder 52 before the motor 25 starts rotating and keeps away from the stocking toe part T. Meanwhile, the relocating members 33, 133 rotate in the arrow-headed direction (clockwise) in FIG. 3 by means of the gears 26, 36, 136 of FIG. 1 in association with the rotation of the motor 25 in the positive direction. Because the relocating members 33, 133 hold a stocking, together with a setting frame F, the toe part T of the stocking on this side of the setting frame F moves to the right and the toe part T of the stocking on the other side of the setting frame F moves to the left in terms of FIGS. 3 and 6 when the relocating members 31, 133 rotate in the above direction. By the reciprocal rotation of the relocating members 33, 133 the seam S on the stocking toe part T is relocated to the circular end of the setting frame F. Now that the relocation is made by the seam locator 40 and the relocating members 33, 133 in a strictly controlled manner, the seam S on the stocking toes part T is put correctly on the circular end of the setting frame F.

Figure 7:
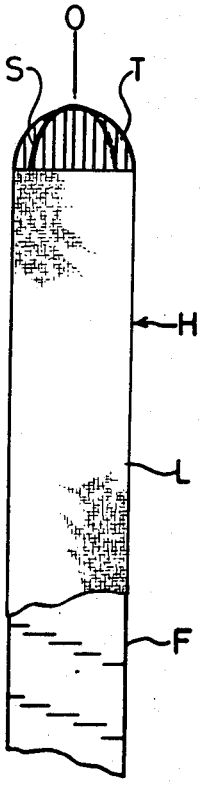

FIG. 7 shows that a seam S is mis-placed in terms of the center line O; the seam S on this side of the setting frame F deviates to the left (and the seam S on the other side to the right nearly symmetrically). In this case, any electrode $B_1, B_2, \ldots B_n$ in the block B gets pressed by a line of the protruded seam S and tells the location of the seam S. When the location of the seam S is told, the motor 25 rotates in the reverse direction for pulses settled in a pressed electrode, which makes the relocating members 33, 133 turn the other way around as shown in FIG. 3. As a result, the seam S on this side moves to the left and the seam S on the other side moves to the right in terms of FIGS. 3 and 7, with the result that the seam S is put on the circular end of the setting frame F correctly.

To sum up, the automatic stocking relocating apparatus of this invention moves the seam S on this side to the right when it is mis-placed to the right in terms of the center line O, and moves the seam S on this side to the left when it is mis-placed to the left in terms of the center line O. For this reason, the relocation can be made rapidly and correctly.

When the relocation of the stocking toe part has thus been finished, the swingable members 30, 130 return to the position out of oparation by the reverse action of the pneumatic cylinder 22, which results in getting the relocation members 33, 133 away from the setting frame F. A setting frame F next to this one stops at the same place and undergoes the same relocation procedure.

Figure 9:
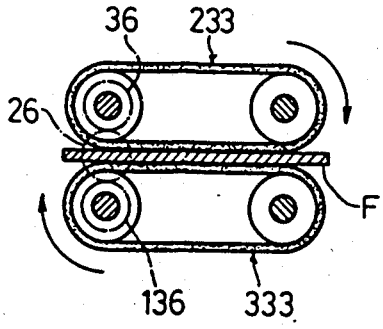
FIGS. 9 and 10 are plan views showing another example of the automatic stocking relocating apparatus of this invention.
Figure 10:
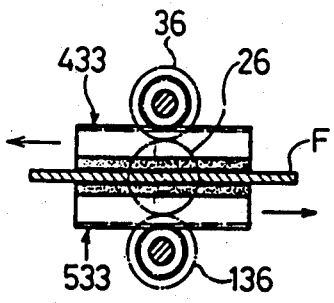

FIGS. 9 and 10 show another example of the relocation members. FIG. 9 shows relocating members 233, 333 constructed of a couple of belts instead of a couple of rollers. FIG. 10 shows relocating members 433, 533 constructed of a pair of racks and a pinion engaged therewith.

The two types of relocating members are equally provided for the swingable members 30, 130. Those couples of relocating members 233, 333; 433, 533 are similarly engaged in the relocation of the stocking toe part; they move in the arrow-headed direction or the direction reverse thereto by the action or the reverse action of the motor 25 by way of the gear 26 and the gears 36, 136, as shown in FIGS. 9 and 10.

Being constructed of belts or racks, those types of relocating members 233, 333, 433, 533 have a considerably larger contact surface in regard to the stocking toe part compared with the roller type ones. Therefore, they are convenient for moving a seam of the stocking toe part. For reference, the relocating members 433, 533 are constructed of racks and are unable to make an endless movement, so the racks have to be returned to the original position from which they have moved in the relocation after the swingable members 30, 130 swing back to the position out of operation.

The above description is made about a system in which setting frames make an intermittent stop while they are advancing on a circular conveyor and the relocation of the stocking toe part is made during the stop. However, the automatic stocking relocating apparatus of this invention is not always restricted to this system only. It can also be applied to another system in which setting frames move continuously on the conveyor. In such a case, the stays supporting the present apparatus 20 are designed to move at the same speed as the conveyor 14 in order that the relocation of the stocking part may be made while the two are moving together in parallel, provided the stays are also designed to return to the original position right after the relocation has been made.

In addition, the above description applies to a case where a pulse motor is used to drive the relocation members but the automatic stocking relocating apparatus of this invention is not always limited to the employment of a pulse motor only. That is, a conventional small motor for all purposes can also be used in a similar manner. In such a case, the motor has to be controlled by means of a timer or the like based on signals transmitted from the seam locator 40.

As described above, the automatic stocking relocating apparatus of this invention is a result of success in inventing a seam locator for the stocking toe part and combining it with a pair of relocating members which automatically make the relocation of the stocking toe part with correctness on a setting frame. Thus, it is the case that the relocating job, conventionally made with the hands, has become replaced with the automatic stocking relocating apparatus of this invention and a fully automated system can be accomplished by providing the present apparatus for a conventional stocking finishing machine. Therefore, in view of the current stocking production, it seems most useful and desirable to use the present apparatus as auxiliary equipment for a stocking finishing machine provided with an automatic stocking feeding device. Additionally, the relocation is made by such a seam locator and relocating members in a well designed automatic fashion that the stocking toe part can be repositioned correctly on the circular end of a setting frame even if it may be mis-placed originally on the setting frame.

I claim:

1. An apparatus for automatically relocating stocking toe parts correctly on setting frames, comprising:

a conveyor on which the setting frames covered with yet steam untreated stockings are transferred;

a steam setter arranged along the conveyor;

swingable members dangling above the conveyor in front of the steam setter;

relocating means, attached to a lower part of said swingable members, for correcting the position of the stocking toe parts; and a seam locator means, attached to one of said swingable members, for locating the position of the stocking toe parts in order for said relocating means to be able to correct the position of the stocking toe parts.

2. An apparatus as claimed in claim 1, in which said relocating means are constructed of a pair of rollers covered with a wear-resistant material and said pair of rollers rotates at the same rotational speed.

3. An apparatus as claimed in claim 1, in which said relocating means are constructed of a pair of endless belts.

4. An apparatus as claimed in claim 1, in which said relocating means are constructed of a pair of racks and a pinion engaged therewith, said racks being able to move in the longitudinal direction of the stockings so as to correct the position of the stocking toe parts.

5. An apparatus as claimed in claim 1, in which said seam locator means is constructed as a single switch element composed of a number of electrodes circuited with each other in parallel at intervals along a base plate, a sheet of piezoelectric conductive rubber which covers said electrodes, and a foil of metal which covers said rubber sheet in a protective manner.

6. An apparatus as claimed in claim 1, in which said swingable members are constructed of a pair of fan-shaped gears and a piston coupled with a pneumatic cylinder which is attached to one of said pair of fan-shaped gears so as to swing said swingable members in association with each other.

* * * * *